US007482539B2

(12) United States Patent
Katsumata et al.

(10) Patent No.: US 7,482,539 B2
(45) Date of Patent: Jan. 27, 2009

(54) ELECTRIC WIRE

(75) Inventors: Makoto Katsumata, Shizuoka (JP); Takeshi Kamata, Shizuoka (JP); Shigeharu Suzuki, Shizuoka (JP); Keigo Sugimura, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/540,143

(22) PCT Filed: Dec. 25, 2003

(86) PCT No.: PCT/JP03/16710

§ 371 (c)(1),
(2), (4) Date: Jun. 21, 2005

(87) PCT Pub. No.: WO2004/061867

PCT Pub. Date: Jul. 22, 2004

(65) Prior Publication Data

US 2006/0070766 A1 Apr. 6, 2006

(30) Foreign Application Priority Data

Dec. 27, 2002 (JP) ..... 2002-381680

(51) Int. Cl.
*H01B 7/00* (2006.01)

(52) U.S. Cl. ..... 174/110 R; 174/112

(58) Field of Classification Search ..... 174/110 R, 174/111, 112, 113 R, 69, 71 R, 72 R, 72 A
See application file for complete search history.

(56) References Cited

U.S. PATENT DOCUMENTS 2,989,943 A 6/1961 Fitzgerald et al. ..... 118/314
3,197,554 A * 7/1965 Baker ..... 174/112
3,663,359 A * 5/1972 Braim ..... 162/105
5,862,774 A * 1/1999 Moss ..... 116/200
6,437,248 B1 * 8/2002 Giebel ..... 174/110 R (Continued)

FOREIGN PATENT DOCUMENTS

JP 55-57908 4/1980

(Continued)

*Primary Examiner*—William H Mayo, III
(74) *Attorney, Agent, or Firm*—Kratz, Quintos & Hanson, LLP

(57) ABSTRACT

The present invention provides electrical cables that can be surely discriminated from one another, even when only a part of an outer surface of each cable is exposed. An electrical cable 1 has an electrically conductive core 5 and a sheathing layer 6 covering the core 5. The sheathing layer 6 has an outer surface 6*a* with a mono-color. On the outer surface 6*a*, a first mark 7 and a second mark 8 are provided. At an end 1*a* of the cable 1, the first mark 7 is provided on a first outer surface 1*b* while the second mark 8 is provided on a second outer surface 1*c* positioned oppositely to the first surface 1*b* of the sheathing layer 6. On the first outer surface 1*b*, a plurality of the first and second marks 7, 8 are provided to be alternately positioned in a longitudinal direction of the cable 1. The first mark 7 has a first color R while the second mark 8 has a second color G different from the first color R. Desirable variation in hue of the first and second colors R, G allows discrimination of the cables 1 from each other.

2 Claims, 8 Drawing Sheets

U.S. PATENT DOCUMENTS

2006/0021785 A1 * 2/2006 Kamata et al. ..... 174/112

FOREIGN PATENT DOCUMENTS

JP 61-24915 2/1986
JP 06-190315 A * 7/1992
JP 6-190315 7/1994
JP 7-5220 1/1995
JP 10-031918 A * 2/1998
JP 2003-168329 * 6/2003
JP 2003-223820 8/2003

* cited by examiner

ELECTRIC WIRE

FIELD OF THE INVENTION

The present invention relates to an electrical cable having a conductor core and an insulating sheathing layer covering the core.

BACKGROUND ART

Automotive vehicles have various types of electronics instruments mounted therein. Therefore, wiring harnesses are arranged for supplying electrical powers from a battery to electronics instruments and for transmitting control signals from a computer. The wiring harness has a plurality of electrical cables 100 shown in FIGS. 9A, 9B and connectors attached to ends of cables.

As shown in FIGS. 9A, 9B, the cable 100 has a conductor core 101 and a sheathing layer 102. The sheathing layer 102 is made of an insulating synthetic material to cover the core 101. That is, the cable 100 is a so-called covered cable. The cable 100 is defined with a step that extrudes an insulating synthetic resin-material on an outer surface of the core 101. The synthetic resin is mixed with a colorant during the extrude process to color the sheathing layer to have a desired color.

The connector has a conductor terminal and a connector housing. The terminal is fitted to an end of the cable 100 to connect with the core 101 of the cable 100. The connector housing is a box to define a terminal accommodation chamber receiving the terminal.

In an assembling process of the wiring harness, the cable 100 is cut to obtain a desirable length, and then a terminal is fitted to an end of the cable 100. When desired, a plurality of the cables 100 are connected to each other. Thereafter, the terminal is inserted into the connector housing to assemble the wiring harness.

It is necessary that the cable 100 is recognized in the diameter of the core 101, the material of the sheathing layer 102, and applications of the cable. The material of the sheathing layer 102 is selected, for example, in view of a heat resistant performance. The applications of the cable 100 include systems for the vehicle such as an air bag, an ABS (antilock brake system), a power transmission mechanism, and a transmission device for signals including vehicle speeds.

To recognize applications of the cable, the cable 100 has a sheathing layer 102 with an outer surface 102*a* that is provided with a stripe pattern. The stripe pattern shown in FIGS. 9A, 9B has two diagonal parallel bands each having a color A or B, and the two colors A and B are different from each other. In production of the cable 100 shown in FIG. 9, a colorant having the color A is mixed in a synthetic resin material during extrusion forming of the sheathing layer 102. After the extrusion forming, the outer surface 102*a* is partially colored with a colorant having the color B.

The cable 100 shown in FIGS. 9A, 9B has a first part having the first color A and a and a second part having the second color B. The first and second parts each extend in a longitudinal direction of the cable parallel with each other. The first part has a width broader than that of the second part.

Meanwhile, there are various requests from users for automotive vehicles. To answer the requests, many various types of electronic instruments are desired to be mounted on the vehicles. Thus, for example, a hundred of types of electrical cables 100 will be prepared to obtain the wiring harnesses. The cables 100 have various colors.

The cable 100 shown in FIGS. 9A, 9B can have various colors by the combination of the color A of the colorant mixed in the synthetic resin material constituting the sheathing layer 102 and the color B for partially coloring the sheathing layer 102. However, when the cables 100 have a small diameter, the cables tend to be difficult in discrimination of them from one another.

Hence, the applicant of the present invention has proposed that a first mark having a first color and a second mark having a second color are provided on an outer surface of a cable in its longitudinal direction. The first and second marks are alternately provided in the longitudinal direction so that a plurality of the cables are easily distinguished from one another.

The wiring harness is fitted with several types of covering fittings such as harness covering tubes, harness protectors, and harness grommets. The covering fittings generally cover the cables. Thus, one of the alternately positioned first and second marks may be covered by the covering fittings not to be recognized.

In this case, the discrimination of the cables is difficult so that terminals fitted to the cables can not be correctly inserted into corresponding terminal chambers.

Therefore, an object of the invention is to provide an electrical cable that can be surely discriminated from one another, even when only a part of an outer surface of the cable is exposed.

DISCLOSURE OF THE INVENTION

For achieving the object, an electrical cable described in claim 1 of the present invention has an electrically conductive core and a sheathing layer covering the core. The sheathing layer is made of a synthetic resin material and has anouter surface with a mono-color. The cable includes:

- a first mark having a first color and provided on a first part of an outer surface of the sheathing layer, and
- a second mark having a second color and provided on a second part of the outer surface of the sheathing layer. The second color is different from the first color, and the second part is positioned oppositely to the first side in a lateral direction of the cable. The first mark is longer than the second mark in a longitudinal direction of the cable.

Since the second mark is positioned in the opposite side of the first mark, the first and second marks are easily recognized even when the outer surface of the cable is partially exposed.

The cables may have a non-colored outer surface, so that the first and second colors are desirably selected to obtain various kinds of the cables differently colored.

In this specification, a colorant is applied to color the outer surface of the sheathing layer of the cable. The colorant is a liquid (industrial organic matter) in which a coloring material is dissolved and distributed in a solvent such as water. The organic matter is a dye or a pigment (a synthetic material mainly composed of organic matters). The dye may be utilized as a pigment and vice versa. In the specification, the colorant means both a coloring liquid and a paint.

The coloring liquid has a dye dissolved or distributed in a solvent. The paint has a pigment distributed in a solvent. The dye soaks into the sheathing layer of the cable when the coloring liquid colors the sheathing layer. Meanwhile, the pigment does not soak into the sheathing layer of the cable but adheres to an outer surface of the sheathing layer, when the coloring liquid colors the sheathing layer. In the specification, the coloring of the cable sheathing layer with the coloring liquid means that the dye soaks partially into the outer surface of the sheathing layer or that the pigment coats partially the outer surface of the sheathing layer.

Preferably, the solvent and the dispersion are affinitive with a synthetic resin constituting the sheathing layer. Thereby, the dye surely soaks into the sheathing layer or the pigment surely adheres to the outer surface of sheathing layer.

Preferably the first and second marks are positioned at an end of the cable.

The first and second marks positioned at an end of the cable are useful to surely distinguish the cables from each other at the cable end. Thus, terminals connected to an end of the cable are correctly received in corresponding terminal chambers of the connector housing.

Preferably the sheathing layer of the cable has a first outer surface and a second outer surface, the first and second outer surfaces each extending in a longitudinal direction of the cable, the first outer surface positioned oppositely to the second outer surface in a lateral direction of the cable, at least one of thefirst and second outer surfaces provided with a plurality of the first and second marks that are alternately positioned. The first and second marks can have a comparatively larger, circumferential width.

Preferably at least three of the first and second marks are provided at the end of the cable. Thus, the first and second marks are surely recognized at the end of the cable.

BEST MODE EMBODYING THE INVENTION

Figure 1:
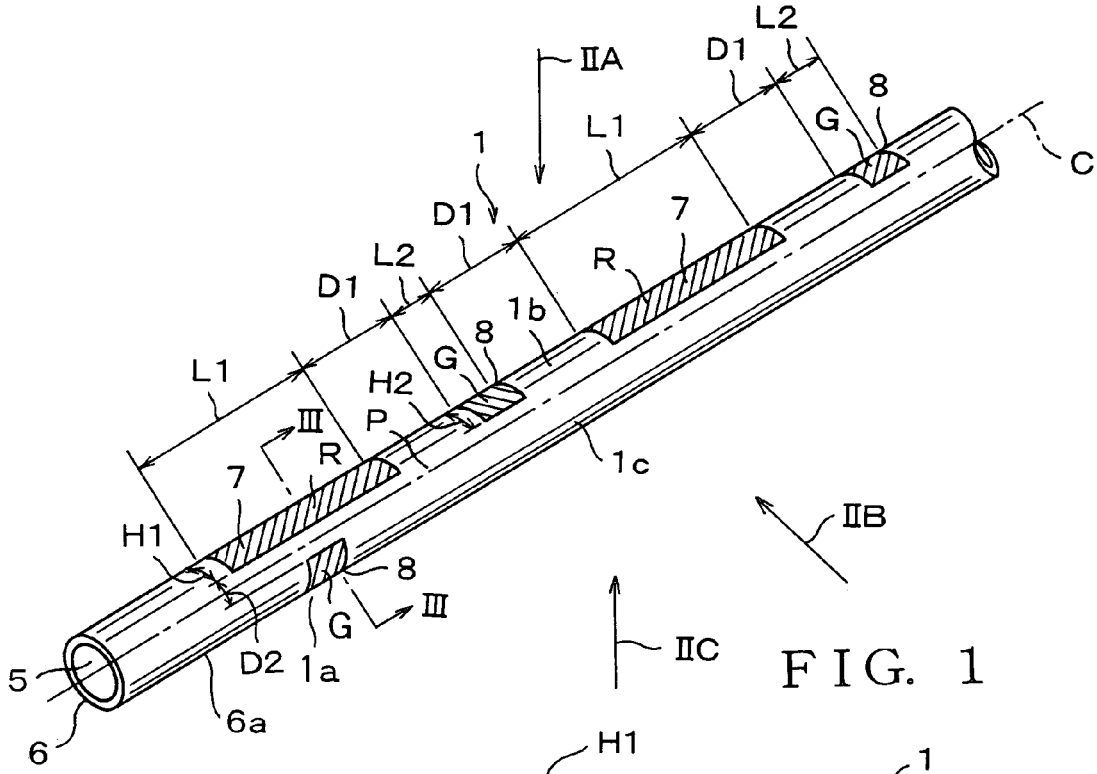
FIG. 1 is a perspective view showing an electrical cable according to a first embodiment of the present invention.

Referring to FIGS. 1 to 5, a first embodiment of the present invention will be discussed hereinafter. FIG. 1 shows an electrical cable 1 according to the first embodiment, which is applied to a wiring harness arranged in an automotive vehicle. The wiring harness has a plurality of electrical cables 1, connectors, harness covering tubes, harness protectors, and grommets, and other covering fittings.

Each connector has a connector housing accommodating a plurality of terminals. Each terminal is made of a conductor metal plate and is fitted to one end 1*a* of an electrical cable 1. The terminal is electrically connected to a conductor core 5 of the cable 1. The connector housing is made of an insulating synthetic resin material and is configured in a box shape. The connector housing has a plurality of terminal chambers accommodating the terminals.

The covering fittings such as the harness tubes are made of an insulating synthetic resin and are configured in a pipe or trough shape. The covering fittings cover the cable 1 and are secured to the cable 1 with winding tapes.

To assemble the wiring harness, firstly, the cable 1 is cut to have a desired length, and a terminal is fitted to one end 1*a* of the cable 1. Then, a plurality of the cables with the terminals are bundled, and the covering fittings cover the bundled cables at desirable positions. The bundled cables and the covering fittings are secured to each other with winding tapes.

When the covering fittings are fitted to the cables 1, the ends 1*a* of the cables are remained to be exposed and not to be covered by the covering fittings. At the ends 1*a* of the cables 1, the cables are distinguished from each other based on a first mark 7 having a first color R and a second mark 8 having a second color G. Thereby, the terminals fitted to the cables 1 can be inserted into corresponding terminal chambers.

The wiring harness is thus assembled. The completed wiring harness is arranged in an automotive vehicle and the connectors of the wiring harness are coupled to other connectors of electronic instruments. The wiring harness supplies powers and signals to the electronic instruments. Note that the cable end 1*a* means a tip and its adjoining portion of the cable.

As shown in FIG. 1, the cable 1 of the wiring harness has a conductor core 5 and an insulating sheathing layer 6. The core 5 is a strand having a plurality of core wires made of an electrically conductive metal. The core 5 may be constituted by a single wire. The sheathing layer 6 is made of, for example, a synthetic resin such as a polyvinyl chloride (PVC). The sheathing layer 6 surrounds the core 5, so that the outer surface 6*a* of the sheathing layer 6 is an outer surface of the cable 1.

The outer surface 6*a* of the sheathing layer 6 has a mono-color P. The mono-color of the outer surface 6*a* of the sheathing layer 6 may be realized by mixing a desired colorant with a synthetic resin constituting the sheathing layer 6. Alternatively, the mono-color may be the original color of the synthetic resin. In the latter case, the sheathing layer 6 or the outer surface 6*a* of the cable 1 is referred to be non-colored.

In the embodiment, a colorant having a white color is mixed with a synthetic resin constituting the sheathing layer 6 so that the outer surface 6*a* has a white mono-color P.

Figure 3:
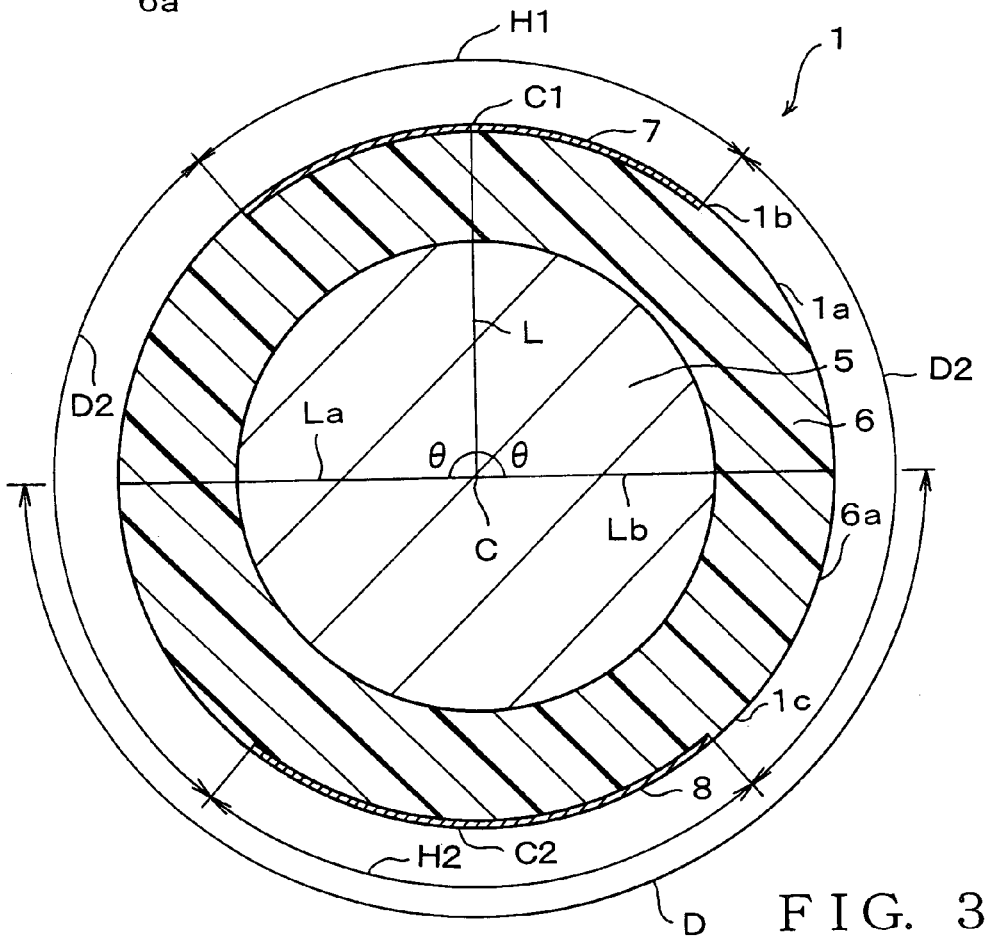
FIG. 3 is a sectional view taken along line 11 of FIG. 1.
Figure 2A:
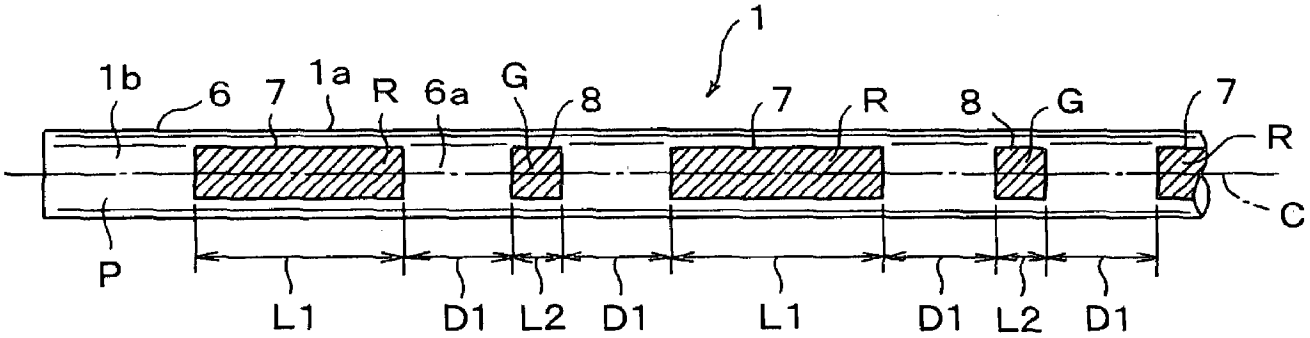
FIGS. 2A, 2B, and 2C are explanative views showing the cable of FIG. 1, the figures being sequentially a top view taken along arrow IIA of FIG. 1, a side view taken along arrow IIB of FIG. 1, and a bottom view taken along arrow IIC of FIG. 1.
Figure 2B:
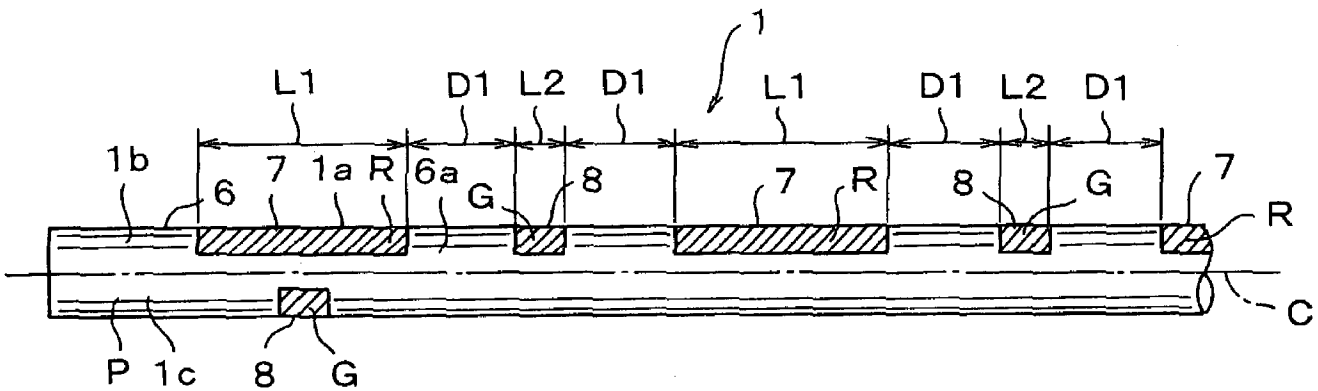
Figure 2C:
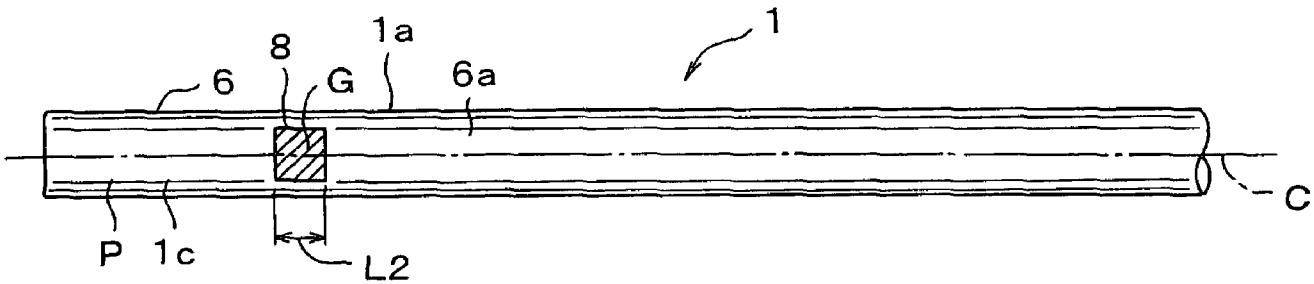

As shown in FIGS. 1, 2A, 2B, and 2C, there are provided a first mark 7 and 8 on the outer surface 6*a* of the cable 1. As shown in FIGS. 2B and 3, there are provided a first mark 7 and a second mark 8 on the one end 1*a* of the cable 1. At the one end 1*a*, the mark 7 is provided on a first surface 1*b* positioned in an upper part of the cable 1 in FIG. 3. Meanwhile, the second mark 8 is provided on a second surface 1*c* positioned in a lower part of the cable 1 in FIG. 3. That is, the second surface 1*c* is located in a side opposite to the first surface 1*b*. In this specification, the first surface 1*b* is an upper half of the outer surface 6*a* of the cable 1 in FIG. 3, while the second surface 1*c* is a lower half of the outer surface 6*a* of the cable 1 in FIG. 3.

That is, the first surface 1*b* and the second surface 1*c* are symmetrically positioned oppositely to each other with an axial center C (shown by a chain line in FIGS. 1 and 2) of the cable 1 therebetween. The axial center C is a line passing the center of the core 5 in a longitudinal direction of the cable 1.

As described above, the second mark 8 is positioned in a rear side of the first mark 7. The rear side is a range where a line La or a line Lb passing the axial center C is more than 90°

(angle θ) relative to a vertical line in FIG. 3. That is, the rear side is a range D of the outer surface 6*a* in FIG. 3.

In the embodiment shown in FIG. 1, the first mark 7 and the second mark 8 are symmetrically positioned with regard to the axial center C. However, in the invention, a middle C2 of the second mark 8 may be positioned in the range D even when the mark 7 and the second mark 8 are not arranged symmetrically with regard to the axial center C.

Furthermore, the first mark 7 and the second mark 8 are alternately positioned in a longitudinal direction of the cable 1 on the first surface 1*b*. On the first surface 1*b* of the sheathing layer 6, the first mark 7 and the second mark 8 are positioned with a distance therebetween over the overall length of the cable 1 along a longitudinal direction of the cable 1.

The first mark 7 extends straight in the longitudinal direction of the cable 1. The first mark 7 has a first color R (shown with parallel diagonal lines in FIG. 1). Thus, the first mark 7 colors a part of the outer surface 6*a* with the first color R. The first color R may be different from the mono-color P or may be the same as the mono-color P.

The second mark 8 extends straight in the longitudinal direction of the cable 1. The second mark 8 has a second color G (shown by parallel diagonal lines in FIG. 1). The second color G is different from the first color R. Thus, the second mark 8 colors a part of the outer surface 6*a* with the second color G. The second color G may be different from the mono-color P or may be the same as the mono-color P.

The first mark 7 has a predetermined length L1 in a longitudinal direction of the cable 1. Adjacent two of the first and second marks 7, 8 are spaced with a predetermined distance D1 in a longitudinal direction of the cable 1. Adjacent two of the first and second marks 7, 8 are spaced with a predetermined distance D2 (see FIG. 3) in a circumferential direction of the cable 1. The second mark 8 has a predetermined length L2 in a longitudinal direction of the cable 1. The length L1 is longer than the length L2.

The cable 1 has the first color R and the second color G which are desirably selected in hue. The desirable selection of the first color R and the second color G allows discrimination of the cables 1 from each other. In a wiring harness used in an automotive vehicle, combinations of the first color R and the second color G of the cables 1 can show types of the cables and systems employing the cables. Preferably, the combination of the first color R and the second color G of the cables 1 is determined similarly to that of the colors A, B of the conventional cables 100. That is, the colors R, G are applied for recognition of application of the cables 1.

The combinations of the first color R and the second color G correspond to connector housings receiving terminals fitted to the ends 1*a* of the cables 1. In FIG. 3, the first and second marks 7, 8 are realized by a coloring liquid discussed later.

Figure 4:
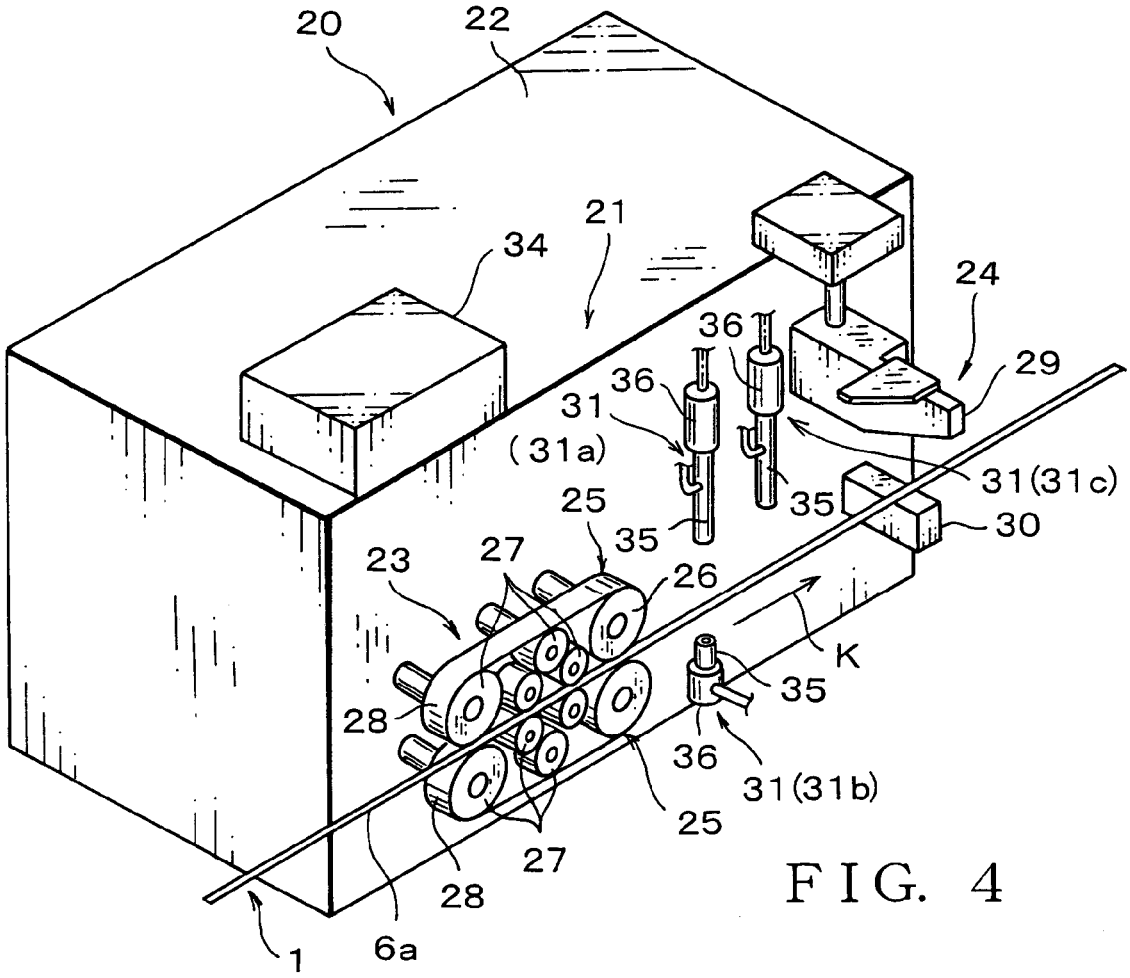
FIG. 4 is a perspective view showing configurations of a cable cutting apparatus having a marking unit providing marks on the cable of FIG. 1.

To provide the first and second marks 7, 8 on the outer surface 6*a* of sheathing layer 6 of the cable, a marking unit 21 shown in FIG. 4 is employed. The marking unit 21 is mounted on a cable cutting installation 20 as shown in FIG. 4.

The cable cutting installation 20, as illustrated in FIG. 4, has a main body 22 disposed on a floor in a factory, a feed length measuring unit 23, and a cutting unit 24. The main body 22 is configured in a box shape. The feed length measuring unit 23 has a pair of feeding belt units 25.

Each feeding belt unit 25 has a driving pulley 26, a plurality of follower pulleys 27, and an endless belt 28. The driving pulley 26 is driven to rotate by a drive unit such as a motor. Each follower pulley 27 is rotatably supported on the main body 22. The endless belt 28 is a ring belt that surrounds the driving pulley 14 and the follower pulleys 15 such that the endless belt 28 moves along the driving pulley 26 and the follower pulleys 27.

The pair of feeding belt units 25 are vertically disposed parallel with each other. The pair of feeding belt units 25 pinch the electrical cable 1 therebetween, and the two driving pulleys 26 rotate at the same speed as each other but each in a direction opposed to each other. This rotates the endless belts 28 to feed the electrical cable 1 as much as a given length.

The feeding belt units 25 feed the electrical cable 1 in a longitudinal direction of the cable 1 which is shown by an arrow K in FIG. 4. The arrow K is along a horizontal direction.

The cutting unit 24 is positioned downstream from the pair of feeding belt units 25 in the arrow direction K. The cutting unit 24 has a pair of cutting blades 29 and 30 which align with each other vertically. The cutting blades 29 and 30 come close to and apart from each other. The pair of cutting blades 29 and 30 come close to each other to pinch the electrical cable 1 fed by the pair of feeding belt units 25 therebetween to cut the cable 1. The pair of cutting blades 29 and 30 come apart from each other to release the cable 1.

Thus configured cutting installation 20 pinches the electrical cable 1 between the pair of feeding belt units 25 to feed the cable along the arrow K while the pair of cutting blades 29 and 30 of the cutting unit 24 are still apart from each other. After the electrical cable 1 is fed as much as the given length, the driving pulleys 26 of the pair of feeding belt units 25 stop. Then, the pair of cutting blades 29 and 30 come close to each other to pinch and cut the electrical cable 1 therebetween. Then the cutting installation 20 feeds the electrical cable 1 along the arrow k again.

Figure 5:
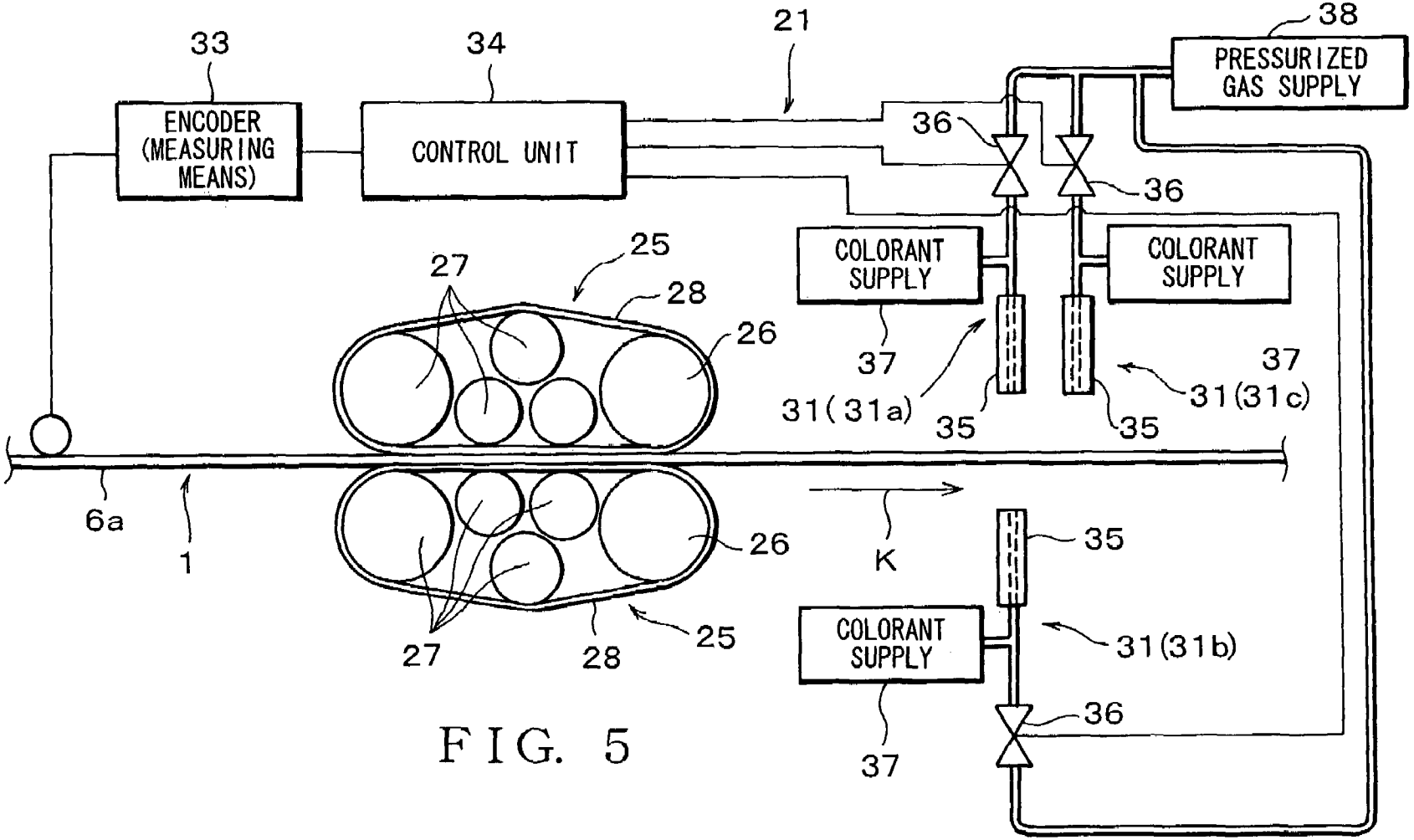
FIG. 5 is an explanative view showing construction of the marking unit of FIG. 4.

The marking unit 21 provides the first and second marks 7, 8 on the outer surface 6*a* of the electrical cable 1. As illustrated in FIG. 5, the marking unit 21 has a plurality of coloring jet units 31, an encoder 33 that is a detection means, and a control unit 34. In the illustrated embodiment, there are provided three of the coloring jet units 31, which are called hereinafter as a first coloring jet unit 31*a*, a second coloring jet unit 31*b*, and a third coloring jet unit 31*c*.

As illustrated in FIG. 4, the coloring jet units 31*a*, 31*b*, 31*c* are disposed between the pair of feeding belt units 25 of the feed length measuring unit 23 and the pair of cutting blades 29, 30 of the cutting unit 14. Each coloring jet unit 31*a*, 31*b*, or 31*c* has a nozzle 35 and a valve 36. The nozzle 35 is opposed to the electrical cable 1 that is moved along the arrow K by the pair of feeding belt units 25. The nozzle 35 receives a colorant R or G from a colorant supply 37 (FIG. 5).

The valve 36 communicates with the nozzle 35, and the valve 36 communicates with a pressurized gas supply 38 (FIG. 5). The pressurized gas supply 38 supplies a pressurized gas to the nozzle 35 through the valve 36. The opening of the valve 36 jets the colorant toward the outer surface 6*a* of the electrical cable 1 through the nozzle 35 by means of the pressurized gas supplied from the pressurized gas supply 38.

The closing of valve 36 stops jetting of the colorant through the nozzle 35. The nozzles 35 of the first and third coloring jet units 31*a* and 31*c* are arranged in a row in the direction K above the cable 1. The nozzle 35 of the second coloring jet unit 31*b* is positioned under the cable 1. The first coloring jet unit 31*a* is opposed vertically to the second coloring jet unit 31*b* with the cable 1 therebetween.

The valve 36 opens during a predetermined time based on signals of the control unit 34 so that each coloring jet unit 31*a*, 31*b*, or 31*c* jets a given amount of the colorant having the given color R or G toward the outer surface 6*a* of the electrical cable 1.

The colorant is a liquid-like material including a coloring material (industrial organic material) dispersedly dissolved in a solvent such as water. The colorant is a die or a pigment, which is generally organic and synthetic. A pigment is sometimes used as a die, and vice versa. More specifically, the colorant T may be either of a coloring liquid and a coating material.

The coloring liquid includes a die dispersed in a solution liquid, and the coating material includes a pigment dispersed in a dispersion liquid. Thus, the die soaks into a sheathing layer when the sheathing layer is coated with the colorant. In the meantime, the pigment adheres on an outer surface 6*a* of a sheathing layer 6 without soaking into the sheathing layer 6 when the sheathing layer 6 is coated with the coating material.

The coloring jet units 31*a*, 31*b*, and 31*c* color a partial outer surface 6*a* of the electrical cable 1 with the die or paint or with the pigment. The marking on the partial outer surface 6*a* of the electrical cable 1 means to color the partial outer surface 6*a* of the electrical cable 1 with the die or to paint the partial outer surface 6*a* of the electrical cable 1 with the pigment.

Preferably, the solvent and the dispersion liquid may be affinitive with a synthetic resin material defining the sheathing layer 6. This makes it sure that the die soaks into the sheathing layer 6 and that the pigment adheres to the outer surface 6*a* of the sheathing layer 6.

The nozzles 35 of the coloring jet units 31*a*, 31*b*, and 31*c* jet the liquid-like colorant on the outer surface 6*a* of the cable 1 with the colorant composed of liquid drops.

The encoder 33 outputs information corresponding to the moving speed of the electrical cable 1 to the control unit 34. The control unit 34 is a computer having a ROM (Read-only Memory), a RAM (Random Access Memory), and a CPU (Central Processing Unit) 47. The control unit 34 is electrically connected to the encoder 33 and the valve 36 to carry out the whole control of the marking unit 21.

The control unit 34 stores a data of the lengths L1, L2 and the distances D1, D2 of the marks 7, 8 that are provided on the outer surface 6*a* of the cable 1. That is, the control unit 34 stores a pattern of the marks 7, 8 provided on the outer surface 6*a*.

The control unit 34 stores the distance between the nozzles 35 of the first and third coloring jet units 31*a*, 31*c*. The control unit 34 opens and closes the valves 36 based on information provided from the encoder 33 so that the first to third coloring jet units 31*a*, 31*b*, 31*c* can jet the colorants toward the outer surface 6*a* of the cable 1 to define the marks 7, 8 on the outer surface 6*a* of the cable 1.

When the making unit 21 provides the first and second marks on the outer 6*a* of the cable 1, the pair of feeding belt units 25 of the cable cutting installation 20 feed the cable 1 along the arrow K.

The control unit 34 controls the valves 36 so that the nozzles 35 of the coloring jet units 31*a*, 31*b*, and 31*c* each jet the colorant by a predetermined amount toward the outer surface 6*a* of the cable 1. The solvent or dispersion vaporizes so that the dye colors the sheathing layer 6 or the pigment adheres to the outer surface 6*a* of the sheathing layer 6. A desired pattern of the first and second marks 7, 8 is defined on the outer surface 6*a* of the cable 1.

After the electrical cable 1 is fed as much as a given length, the pair of feeding belt units 25 of the cutting installation 20 stop. The pair of cutting blades 29 and 30 of the cutting unit 24 cut the cable 1 that has been provided with the first and second marks 7, 8 on the outer surface 6*a*. Thus, the cable 1 having the first and second marks 7, 8 on the outer surface 6*a* is obtained as shown in FIG. 1.

In the embodiment, at the one end 1*a* of the cable, the first mark 7 is provided on the first surface 1*b* while the second mark 8 is provided on the second surface 1*c*. The second mark is positioned in an opposite side of the first mark. Therefore, the first and second marks 7, 8 are easily recognized even when an outer surface of the cable is partially exposed.

Accordingly, the cables 1 are surely distinguished from each other at the one end 1*a* of the cable. Thus, terminals connected to an end of the cable are correctly received in corresponding terminal chamber of a connector housing. This allows correct discrimination of the cables 1 so that the cables 1 are correctly arranged during assembling of a wiring harness to keep quality of the wiring harness.

The first mark 7 having the first color R and the second mark 8 having the second color G are provided on the cable outer surface 6*a* having a mono color P. Thus, the first and second colors R and G provided on the outer surface 6*a* having the mono color are changed to obtain various types of the cable 1. Furthermore, a stock of the cables 1 can be reduced in a factory for producing the cables of the wiring harnesses. This reduces a production cost of the cables 1 and of products utilizing the cables 1 such as the wiring harnesses.

On the first surface 1*b* of the cable 1, the first and second marks 7, 8 are longitudinally positioned in a row with a distance between. The first and second marks 7, 8 of the cable 1 each have a circumferential width H1 or H2 as shown In FIGS. 1 and 3. The width H1 or H2 can be comparatively large. Thus, the first and second marks 7, 8 are easily recognized, even when the cable has a small diameter.

Furthermore, the first mark has a length L1 and the second mark has a length L2. The length L1 is longer than the length L2, and the first and second marks 7, 8 are longitudinally positioned with a distance therebetween. Thus, the first and second marks 7, 8 are easily recognized and distinguished from each other. This allows correct discrimination of the cables 1 so that the cables 1 are correctly arranged during assembling of a wiring harness to keep quality of the wiring harness.

Figure 6:
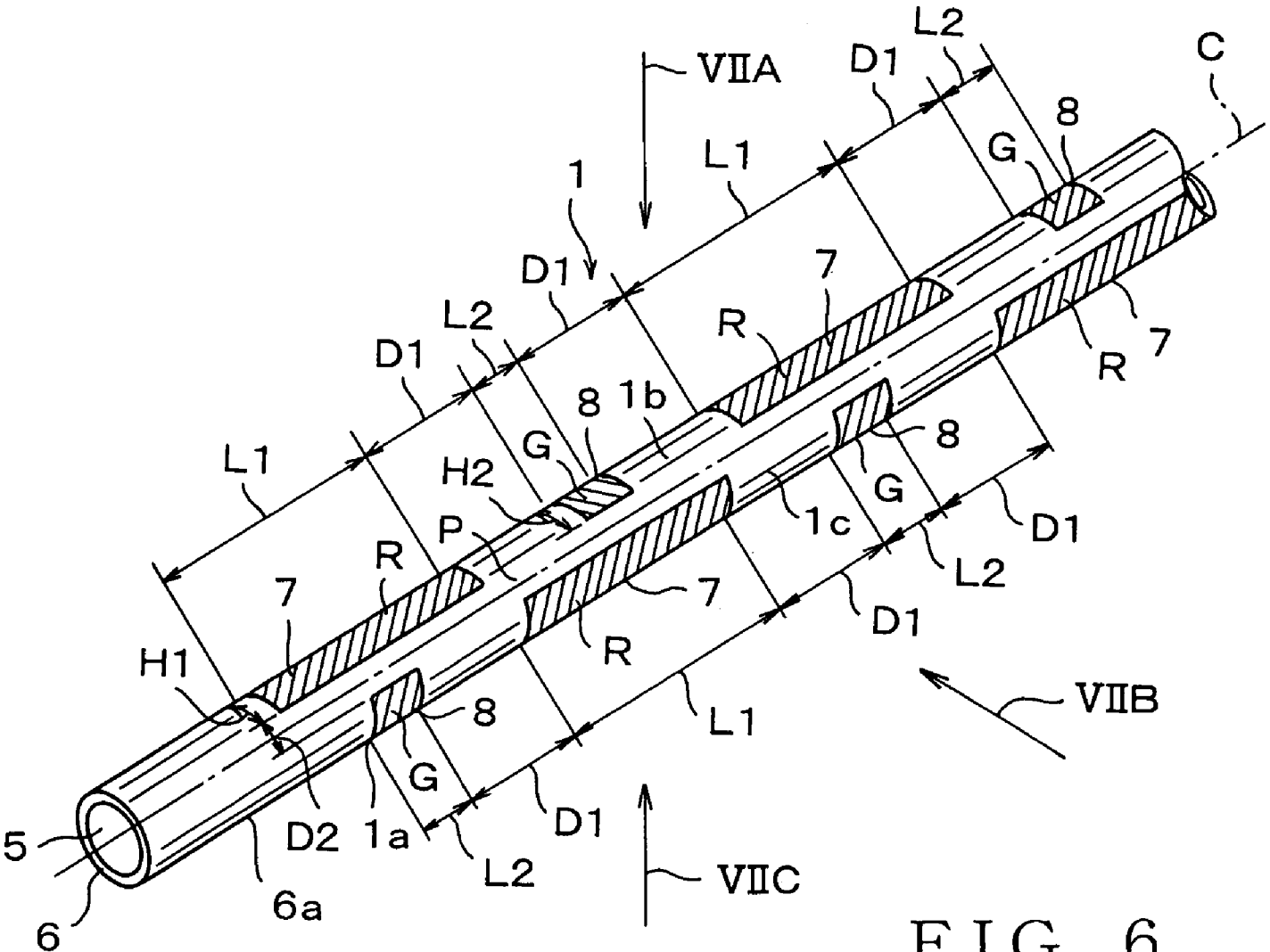
FIG. 6 is a perspective view showing an electrical cable according to a second embodiment of the present invention.
Figure 7A:
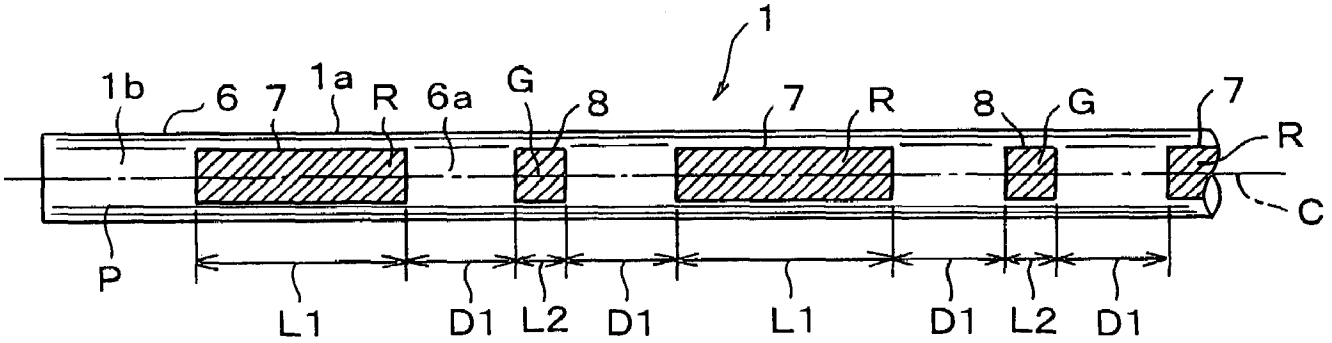
FIGS. 7A, 7B, and 7C are explanative views showing the cable of FIG. 6, the figures being sequentially a top view taken along arrow VIIA of FIG. 6, a side view taken along arrow VIIB of FIG. 6, and a bottom view taken along arrow VIIC of FIG. 6.
Figure 7B:
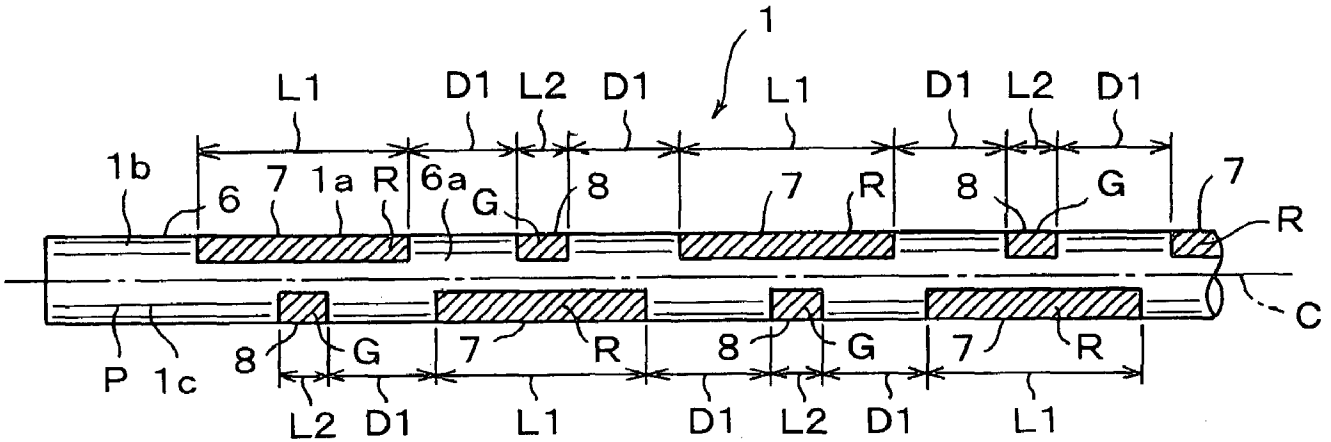

Referring to FIGS. 6 and 7, a second embodiment of the present invention will be discussed. The same component as that of the first embodiment is designated by the same reference numeral of the first embodiment. In the second embodiment, as shown in FIGS. 6 and 7B, the first and second marks 7, 8 are arranged alternately on each of the first and second surfaces 1*b*, 1*c* over the overall length of the cable 1.

In the second embodiment, at the one end 1*a* of the cable, the first and second marks 7, 8 are provided on the outer surface 6*a*. The second mark 8 is positioned in an opposite side of the first mark 7 at the one end 1*a* of the cable. The first and second marks 7, 8 are positioned symmetrically with the axial center C. Likewise, the first and second marks 7, 8 provided on the surfaces 1*b*, 1*c* are oppositely and symmetrically positioned with the axial center C of the cable.

Figure 7C:
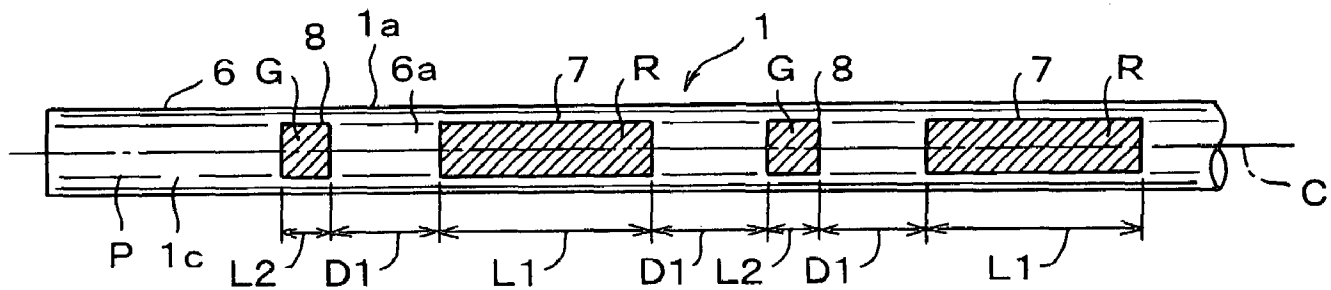

In the second embodiment, as shown in FIGS. 7A and 7C, the first mark 7 has a length L1 and the second mark 8 has a length L2. The first and second marks 7, 8 are longitudinally positioned with a distance D1 or D2 therebetween.

In the second embodiment, like the first embodiment, the second mark 8 is positioned in an opposite side of the first mark 7 at the one end 1*a* of the cable 1. Therefore, the first and second marks are easily recognized even when an outer surface of the cable is partially exposed.

Accordingly, the cables 1 are surely distinguished from each other at the one end 1*a* of the cable. Thus, terminals connected to an end of the cable are correctly received in corresponding terminal chambers of a connector housing. This allows correct discrimination of the cables 1 so that the cables 1 are correctly arranged during assembling of a wiring harness to keep quality of the wiring harness.

The first mark 7 having the first color R and the second mark 8 having the second color G are provided on the cable outer surface 6*a* having the mono color P. Thus, the first and second colors R and G provided on the outer surface 6*a* having the mono color are changed to obtain various types of the cable 1. Furthermore, a stock of the cables 1 can be reduced in a factory for producing the cables of the wiring harnesses. This reduces a production cost of the cables 1 and of products utilizing the cables 1 such as wiring harnesses.

On each of the surfaces 1*b*, 1*c* of the cable 1, the first and second marks 7, 8 are longitudinally positioned in a row with a distance between. The first and second marks 7, 8 of the cable 1 each have a circumferential width H1 or H2 as shown in FIGS. 1 and 3. The width H1 or H2 can be comparatively large. Thus, the first and second marks 7, 8 are easily recognized, even when the cable has a small diameter.

Furthermore, the first mark 7 has the length L1 and the second mark has the length L2. The length L1 is longer than the length L2, and the first and second marks 7, 8 are longitudinally positioned with a distance therebetween. Thus, the first and second marks 7, 8 each having the first or second color are easily recognized and distinguished from each other. This allows correct discrimination of the cables 1 so that the cables 1 are correctly arranged during assembling of a wiring harness to keep quality of the wiring harness.

Figure 8:
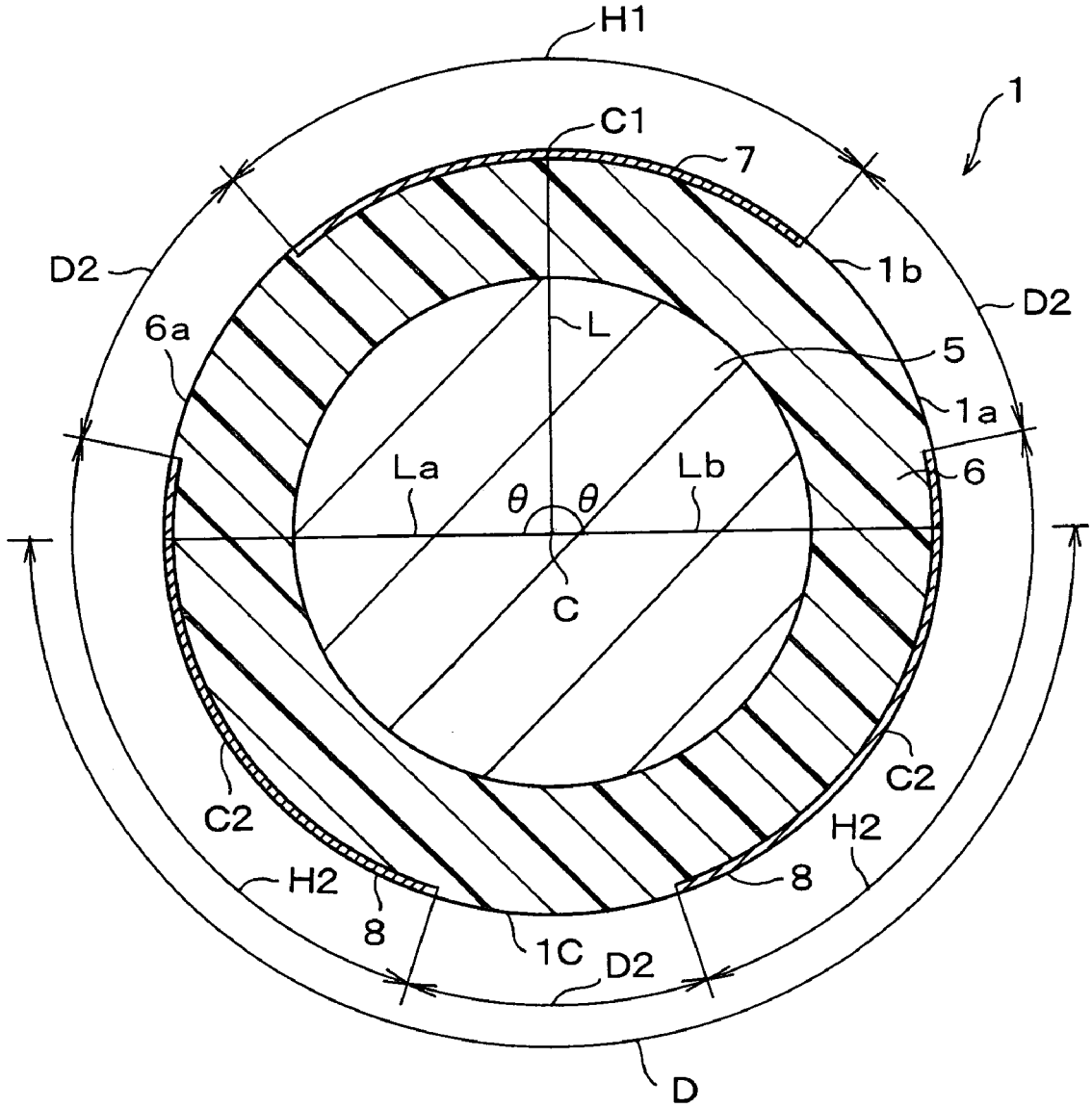
FIG. 8 is a sectional view showing one end of an electrical cable according to a modified embodiment of the present invention.
Figure 9A:
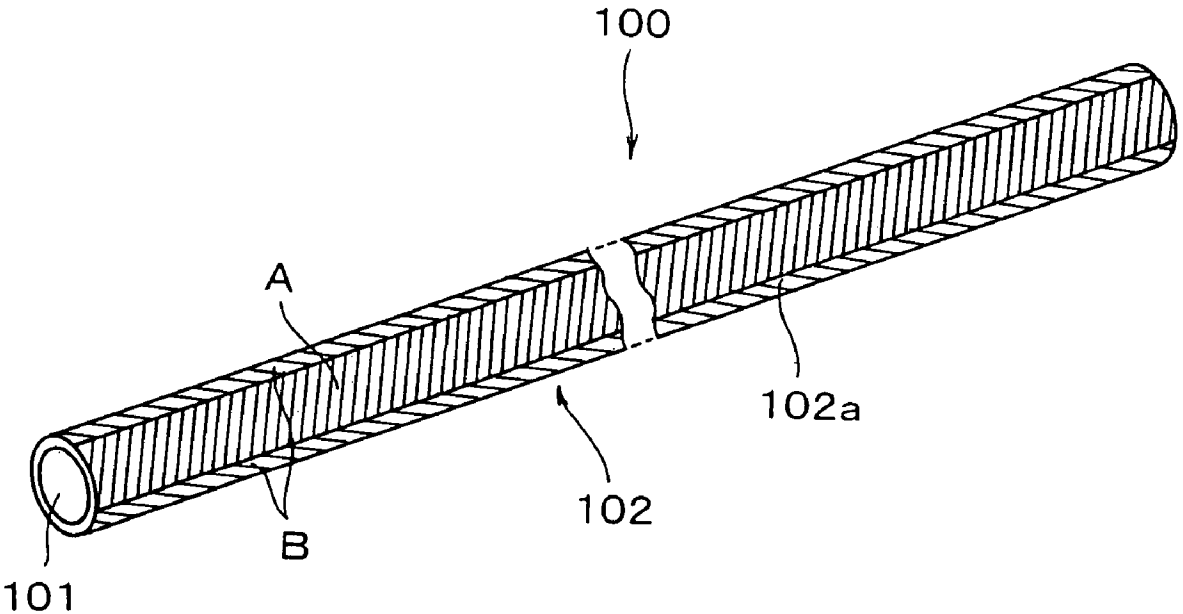
FIG. 9A PRIOR ART
FIGS. 9A and 9B are explanative views showing a conventional electrical cable, the figures being sequentially a perspective view and a side view.
Figure 9B:
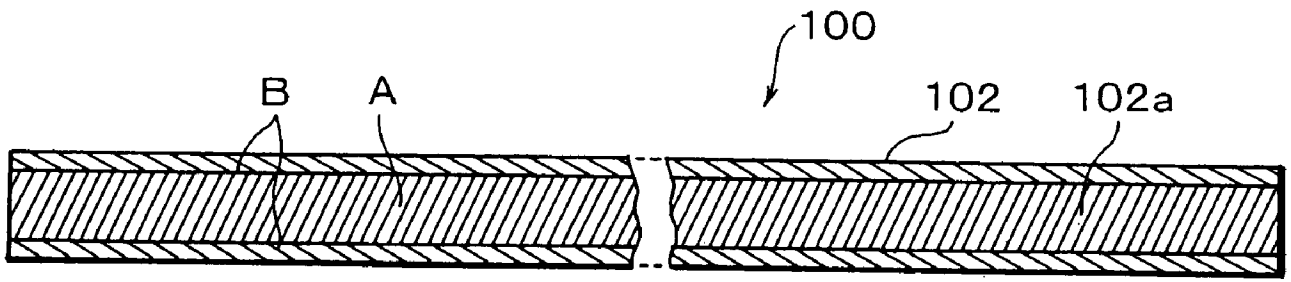
FIG. 9B PRIOR ART

In the aforementioned embodiments, a pair of the first and second marks 7, 8 are provided on the one end 1*a* of the cable 1. However, according to the present invention, the first and second marks 7, 8 may be provided more than two at the one end 1*a*. In FIG. 8, the first and second marks 7, 8 are three, which are arranged circumferentially with the cable 1 with regular intervals D2. Even when more than two of the first and second marks 7, 8 are provided on the one end 1*a*, at least one of the second marks 8 is preferably positioned generally in the opposite side of the first mark 7.

In the aforementioned embodiments, the second mark 8 is positioned oppositely to the first mark 7 at the one end 1*a* of the cable 1. However, according to the present invention, the second mark 8 is positioned oppositely to the first mark 7 at a longitudinally middle part of the cable 1.

In the aforementioned embodiments, the outer surface 6*a* of the cable 1 is white. However, according to the present invention, the outer surface 6*a* of the sheathing layer 6 may be non-colored without mixing a colorant into the resin of the sheathing layer 6. The mono-color P on the outer surface 6*a* of the sheathing layer 6 may be a bright color having a brightness class not less than 8 defined by JIS (Japanese Industrial Standard).

In the aforementioned embodiments, the marking unit 21 has the three coloring jet units 31. However, according to the present invention, there are provided two or more than three of the marking units 31 may be employed.

In the aforementioned embodiments, the colorant liquid is jetted by a given amount toward the outer surface 6*a* of the cable 1 to define the first and second marks 7, 8. However, according to the present invention, the outer surface 6*a* of the cable 1 may be partially dipped in a colorant liquid to define the first and second marks 7, 8. Furthermore, an aerosol of the colorant mixed with a pressurized gas may be jetted on the outer surface 6*a* of the sheathing layer 6 to define the first and second marks 7, 8.

In the aforementioned embodiments, the marking unit 21 defining the first and second marks 7, 8 is mounted on the cutting installation 20. However, according to the present invention, the marking unit 21 may be mounted on an apparatus prepared in another step for completing the cables 1 to assemble a wiring harness.

In the aforementioned embodiments, the control unit 34 has a computer having a ROM, a RAM, and a CPU. However, the present invention may have a known digital circuit in place of the control unit 34. Preferably, the digital circuit may have a circuit for counting pulse signals output from the encoder 33 and another circuit for determining whether the valve 36 shall be opened or closed based on the number of the pulse signals.

The aforementioned embodiments describe the cables 1 used for completing wiring harnesses arranged in an automotive vehicle. However, the cables 1 may be utilized for assembling various types of electronic instruments and electrical machines.

In the present invention, the coloring liquid and the paint material may be acrylic paints, inks used as dies or pigments, UV (ultra violet) inks, etc.

INDUSTRIAL APPLICABILITY OF THE INVENTION

As discussed above, the second mark is positioned in the opposite side of the first mark. Therefore, the first and second marks are easily recognized even when an outer surface of the cable is partially exposed. Thus, the first and second marks 7, 8 are easily recognized and distinguished from each other. This allows correct desrimination of the cables 1 so that the cables 1 are correctly arranged during assembling of a wiring harness to keep quality of the wiring harness.

Furthermore, The first and second marks are provided on the cable outer surface having the mono color. Thus, the first and second colors provided on the cable outer surface having the mono color are changed to obtain various types of the cables. Furthermore, a stock of the cables can be reduced in a factory for producing the cables of the wiring harnesses. This reduces a production cost of the cables and of products utilizing the cables such as the wiring harnesses.

In the present invention, the first and second marks are positioned at an end of the cable. Therefore, the first and second marks are easily recognized even when an outer surface of the cable is exposed only at the end of the cable. This allows correct discrimination of the cables so that the cables are correctly arranged during assembling of a wiring harness to keep quality of the wiring harness.

Regarding the invention, the sheathing layer of the cable has the first and second outer surfaces each extending in a lateral direction of the cable. The first outer surface is positioned oppositely to the second outer surface in a lateral direction of the cable. At least one of the first and second outer surfaces is provided with a plurality of the first and second marks that are alternately positioned. The first and second marks can have a comparitively larger, circumferential width.

Therefore, the first and second marks are easily recognized. This allows correct discrimination of the cables so that the cables are correctly arranged during assembling of a wiring harness to keep quality of the wiring harness.

Regarding the present invention, at least three of the first and second marks are provided at the end of the cable. Thus, the first and second marks are surely recognized at the end of the cable. Therefore, the first and second marks are easily recognized even when an outer surface of the cable is exposed only at the end of the cable. Thisallows correct descrimination of the cables so that the cables are correctly arranged during assembling of a wiring harness to keep quality of the wiring harness.

The invention claimed is:

1. An electrical cable having a conductor core and a sheathing layer covering the core, the sheathing layer made of a synthetic resin material and having an outer surface with a mono-color, the cable comprising:

a first mark having a first color and provided on a first outer surface portion of an outer surface of the sheathing layer, and a second mark having a second color and provided on a second outer surface portion of the outer surface of the sheathing layer, wherein the second color is different from the first color, and the second outer surface portion is positioned opposite the first outer surface porton in a circumferential direction of the cable, the first and second marks positioned at an end of the cable so as to be opposite to each other in relation to an axial center af the cable, wherein the sheathing layer of the cable has the first and second outer surface portions each extending in a longitudinal direction of the cable, at least one of the first and second outer surface portions is provided with a plurality of the first and second marks that are alternately positioned in the longitudinal direction of the cable, and the first mark is longer than the second mark in the longitudinal direction of the cable.

2. The cable recited in claim 1, wherein at least three of the first and second marks are provided at the end of the cable in a circumferential direction of the cable with regular intervals.

* * * * *